US007413294B2

(12) United States Patent
Tobita et al.

(10) Patent No.: US 7,413,294 B2
(45) Date of Patent: Aug. 19, 2008

(54) INKJET HEAD WITH HIGH DENSITY NOZZLE PACKING

(75) Inventors: Satoru Tobita, Ibaraki (JP); Yoshitaka Akiyama, Ibaraki (JP); Toshiharu Sumiya, Ibaraki (JP); Yoshikane Matsumoto, Ibaraki (JP)

(73) Assignee: Ricoh Printing Systems, Ltd., Tokyo (JP)

( * ) Notice: Subject to any disclaimer, the term of this patent is extended or adjusted under 35 U.S.C. 154(b) by 462 days.

(21) Appl. No.: 10/788,349

(22) Filed: Mar. 1, 2004

(65) Prior Publication Data

US 2004/0169704 A1 Sep. 2, 2004

(30) Foreign Application Priority Data

Feb. 28, 2003 (JP) ..... P. 2003-052107

(51) Int. Cl.
*B41J 2/17* (2006.01)
*B41J 29/38* (2006.01)
*B41J 2/45* (2006.01)

(52) U.S. Cl. ..... 347/84; 347/12; 347/70

(58) Field of Classification Search ..... 347/70, 347/71

See application file for complete search history.

(56) References Cited

U.S. PATENT DOCUMENTS 4,680,595 A * 7/1987 Cruz-Uribe et al. ..... 347/40
5,612,725 A * 3/1997 Okimoto ..... 347/71
5,880,763 A * 3/1999 Tanaka et al. ..... 347/70
6,036,303 A * 3/2000 Yamamoto et al. ..... 347/70
6,142,615 A * 11/2000 Qiu et al. ..... 347/70
6,209,992 B1 * 4/2001 Hashizume ..... 347/65
6,309,056 B1 * 10/2001 Sando et al. ..... 347/70
6,485,133 B1 * 11/2002 Teramae et al. ..... 347/68
6,874,869 B1 * 4/2005 Hollands et al. ..... 347/68

FOREIGN PATENT DOCUMENTS

JP 63-104843 5/1988
JP 02220848 A * 9/1990

(Continued)

OTHER PUBLICATIONS

English Translation of "Ink Jet Head," Kamisuke et al., JP 06008449A, translated May 2007.*

*Primary Examiner*—Matthew Luu
*Assistant Examiner*—Shelby Fidler
(74) *Attorney, Agent, or Firm*—McGinn IP Law Group, PLLC

(57) ABSTRACT

An inkjet head includes a common ink puddle section, a nozzle plate having a plurality of nozzle orifices, an ink flow channel substrate having grooves communicating from the common ink puddle section to the nozzle orifices, and being formed alternatively in front and back surfaces of the ink flow channel substrate, to end sections of the grooves the nozzle plate being fixed, a chamber plate being stacked on the ink flow channel substrate, and having pressure generation chambers corresponding to the nozzle orifices, a diaphragm stacking on the chamber plate opposite from the ink flow channel substrate, a pressure generator provided on the diaphragm for the respective pressure generation chambers to generate a change in an internal pressure. Preferably, a volumetric capacity of the pressure generation chambers is changed in accordance with a change in the pressure, to eject an ink droplet from the nozzle orifice.

21 Claims, 6 Drawing Sheets

FOREIGN PATENT DOCUMENTS

| | | |
|---|---|---|
| JP | 04-193546 | 7/1992 |
| JP | 6-8422 | 1/1994 |
| JP | 6-8449 | 1/1994 |
| JP | 11-254674 | 9/1999 |
| JP | 2000-289233 | 10/2000 |

* cited by examiner

INKJET HEAD WITH HIGH DENSITY NOZZLE PACKING

BACKGROUND OF THE INVENTION

1. Field of the Invention

The invention relates to an inkjet head, and more specifically, to mounting and configuration of an inkjet head nozzle used for the inkjet head.

2. Background Art

In association with proliferation of personal computers and progress in graphic processing programs, an output of a hard copy having a high image quality as well as an output of a character have come to be required in connection with inkjet printing. In the field of printing of a signboard or a large-sized poster, many on-demand print requests are issued. For these reasons, an on-demand inkjet recording apparatus has been frequently used.

An inkjet head used in the on-demand inkjet recording apparatus is roughly divided into three types. Namely, a first type of inkjet head is a so-called thermal jet inkjet head which is equipped with a heater for momentarily vaporizing ink disposed at the extremity of a nozzle, thereby producing and ejecting an ink droplet by means of expansion pressure derived from vaporization. A second type of inkjet head is an inkjet head utilizing shear-mode deformation of a piezoelectric element, wherein a container for forming an ink puddle section is equipped with a piezoelectric element which becomes deformed in accordance with a signal, and wherein an ink droplet is ejected by means of pressure derived from deformation. A third type of inkjet head is an inkjet head where in a piezoelectric element is disposed so as to oppose a pressure generation chamber formed from an ink puddle section, and an ink droplet is ejected by inducing dynamic pressure in the pressure generation chamber by means of contraction and extraction of the piezoelectric element. Electrostatic absorption is utilized in place of a piezoelectric element.

In the on-demand inkjet head of the third type, a plurality of nozzle orifices are arranged in a row on a chamber plate, and a plurality of plates are stacked to constitute an ink chamber. A piezoelectric element is mounted so as to oppose the ink chamber, and an ink droplet is ejected by utilization of deformation of the piezoelectric element (see e.g., JP-A-6-8422).

In the case of the inkjet head, when a nozzle packaging density, that is, a pitch between nozzles, has become small, the pitch between the ink chambers eventually becomes smaller, along with the piezoelectric element. To prevent such a reduction in pitch or size, nozzles are arranged in a plurality of rows within a head, and nozzles of the respective rows are offset from each other, thereby attempting to increase a print density which can be achieved by one scanning operation (see, e.g., JP-A-2000-289233). However, a plurality of rows of nozzles are provided in one plate, and hence piezoelectric transducers must also be formed for respective rows of nozzles so as to oppose the nozzles, because the piezoelectric transducers oppose nozzles when packaged.

FIG. 10 shows another related-art example of means for increasing the packaging density of nozzles. FIG. 10 is a schematic plan view showing a state in which a nozzle plate 101 has a plurality of nozzle orifices 100, a state of a chamber plate 103 in which the pressure generation chambers 102 are alternately arranged thereon in a staggered arrangement with respect to the nozzle orifices 100 arranged on the nozzle plate 101, and a state in which a piezoelectric element 150 divided in a comb-shaped pattern are fixed so as to oppose a pressure generation chamber 102 sealed with a diaphragm 104. In the case of such a configuration, since the pressure generation chambers 102 are arranged in a staggered arrangement, the corresponding piezoelectric elements 15 are also arranged in a staggered arrangement. Specifically, two groups of piezoelectric elements located very close to each other must be inserted and fixed with superior accuracy. Therefore, there arises a problem of poor ease of assembly.

In some inkjet heads, a silicon monocrystal substrate is taken as a constituent member, and nozzles formed in one surface of the silicon monocrystal substrate and those formed in the other surface are arranged in a staggered pattern within a single plane made by slicing a predetermined position on the silicon monocrystal substrate (see, e.g., JP-A-6-8449). In this case, the nozzle orifices, the pressure chambers, and restrictors are formed simultaneously in the silicon monocrystal substrate. Hence, the nozzle orifices formed in both surfaces of the substrate must assume a staggered arrangement.

SUMMARY OF THE INVENTION

In order to increase the packaging density of an inkjet head or the number of nozzles, an attempt must be made to improve ease of machining and ease of assembly. If an increase arises in the number of parts or the number of locations to be aligned, the accuracy of machining or assembly will be lowered. Hence, a high-quality inkjet head cannot be manufactured stably.

In particular, in relation to printing to be performed by the inkjet recording apparatus, demand has recently arisen for higher speed and higher quality. In relation to an industrial application, increasing demand exists for a patterning field for manufacturing, e.g., an organic EL display, instead of the field of a liquid-crystal display, and an inkjet head has come to be used with a view toward ejecting a special solution. In order to complete patterning by one coating operation with the objective of achieving high precision and suppressing variations in surface, demand exists for a nozzle package of higher density.

However, according to the technique for increasing the density through use of a single row of nozzles, micro machining of transducers and cementing the transducers to a diaphragm are not easy. To solve the problem, nozzles are arranged in a plurality of rows on a single plate, to thereby enhance packaging density. This requires a group of transducers provided for each row of nozzles, which in turn results in an increase in the number of locations to be aligned and presents a problem of deterioration of operability and a cost hike. A print direction is limited solely to a direction in which a plurality of nozzles are arranged. Therefore, in the case of a head-fixed line recorder, the configuration of the apparatus is limited solely to a packaging method for arranging heads in a staggered arrangement. The area of a head section becomes larger, and a head maintenance section or the entire apparatus eventually becomes bulky.

In the case of the configuration shown in FIG. 10, two groups of piezoelectric elements must be fastened in a very narrow area while being offset accurately, thus deteriorating operability.

The present invention has been conceived in light of the problem set forth and aims at providing an inkjet head having a structure for enabling packaging of ink chambers and nozzles with a relationship characterized by superior efficiency.

According to an aspect of the invention, an inkjet head includes a common ink puddle section, a nozzle plate having a plurality of nozzle orifices arranged thereon, an ink flow channel substrate having grooves, the grooves communicating from the common ink puddle section to the nozzle orifices, the grooves being formed alternatively in front and back surfaces of the ink flow channel substrate, to end sections of the grooves the nozzle plate being fixed, a chamber plate being stacked on the ink flow channel substrate, the chamber plate having pressure generation chambers corresponding to the nozzle orifices, the pressure generation chambers being larger in width than the grooves, a diaphragm stacking on one surface of the chamber plate opposite from the other surface stacking on the ink flow channel substrate, a pressure generator provided on the diaphragm for the respective pressure generation chambers to generate a change in an internal pressure of the pressure generation chambers. Preferably, the common ink puddle section remains in communication with the pressure generation chambers to supply ink to the pressure generation chambers, and a volumetric capacity of the pressure generation chambers is changed in accordance with a change in the pressure of the pressure generation chambers, to eject an ink droplet from the nozzle orifice.

BRIEF DESCRIPTION OF THE DRAWINGS

The present invention may be more readily described with reference to the accompanying drawings.

DETAILED DESCRIPTION OF THE PREFERRED EMBODIMENTS

Figure 1:
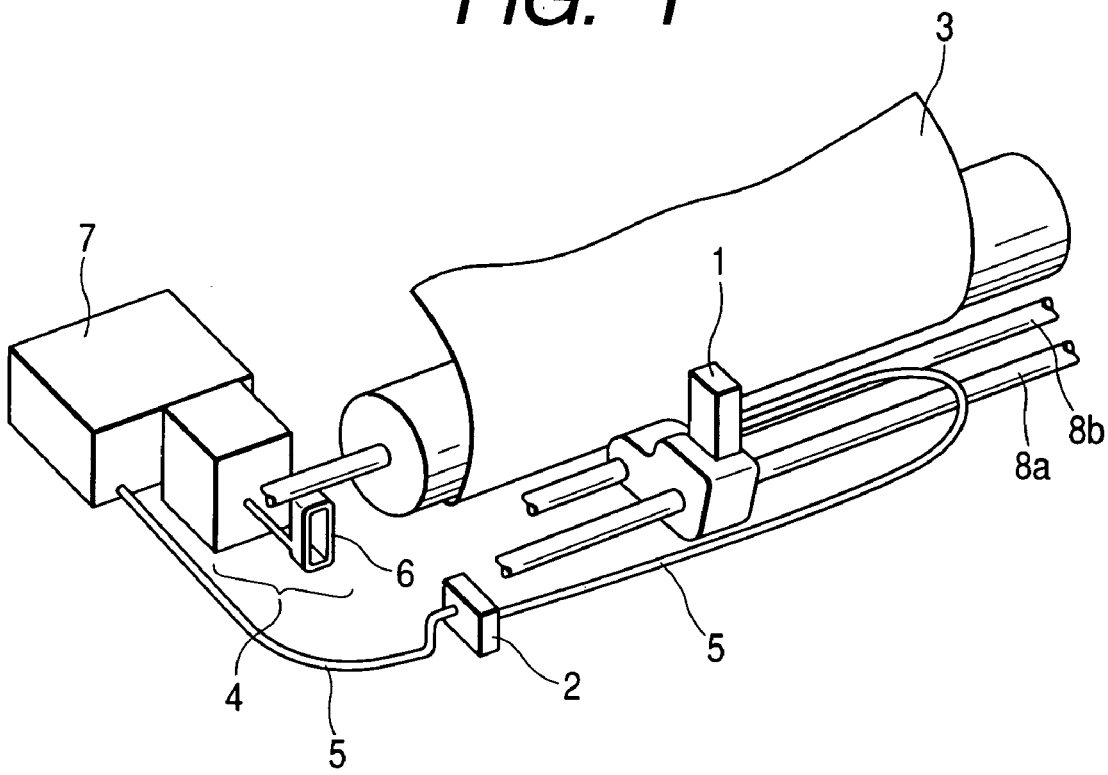
FIG. 1 is a perspective view showing an embodiment of a recording apparatus equipped with an inkjet head of the invention.

FIG. 1 shows an embodiment of an inkjet recorder. This embodiment is an example of serial-scanning print type. The present invention can also be applied to an inkjet recorder of line print type employing a fixed head. The inkjet head of the invention presents no problem even when used as a head of a dispenser for use in, e.g., an industrial application other than a printer, or a head for use with an inkjet three-dimensional molding apparatus.

In the drawing, reference numeral 1 designates an inkjet head, 2 designates a sub-ink tank, 3 designates print paper, and 4 designates a head maintenance section. The inkjet head 1 is coupled to an unillustrated timing belt and prints characters, figures, or the like by ejecting ink droplets on the print paper 3 while being moved back and forth over guide shafts 8*a*, 8*b* through forward and reverse rotation of an unillustrated drive motor. Ink is supplied to the inkjet head 1 by feeding ink from a main tank 7 to the sub-ink tank 2 by way of a supply tube 5 and further to the inkjet head 1 by way of the supply tube 5. The head maintenance section 4 is equipped with a cap 6 that protects nozzles of the inkjet head 1 from dry ink or adhesion of extraneous matter when no printing is performed or with an unillustrated wiper blade for removing the ink adhering to a nozzle surface. The cap 6 is also utilized as a suction cap to be used for filling the head 1 with ink from the sub-ink tank 2 or for performing a purging operation with a view toward eliminating air bubbles or the like remaining stationary in the head 1.

Figure 2:
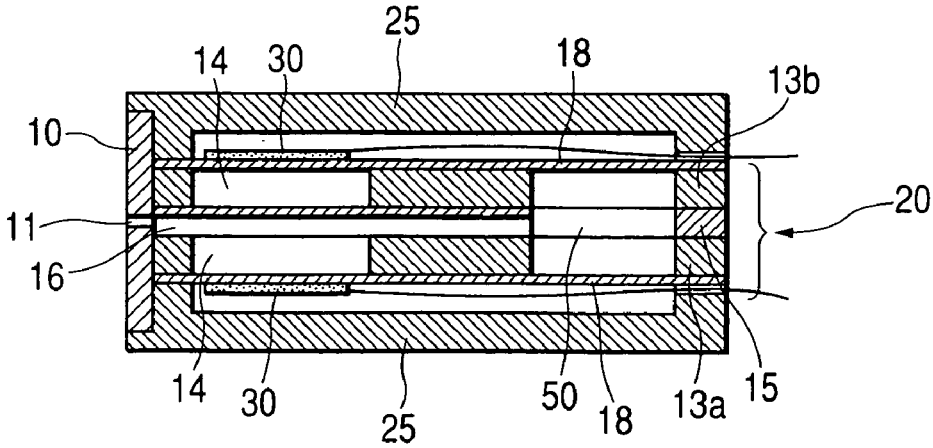
FIG. 2 is a cross-sectional view of the inkjet head of the invention.
Figure 3:
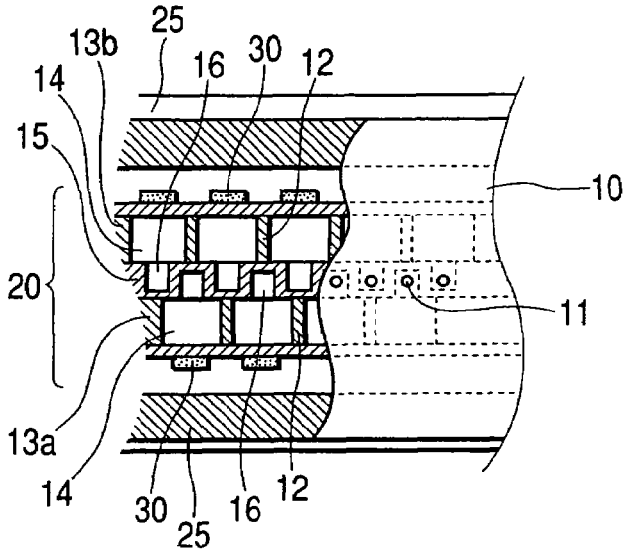
FIG. 3 is a cutaway plan view of the inkjet head of the invention.
Figure 4:
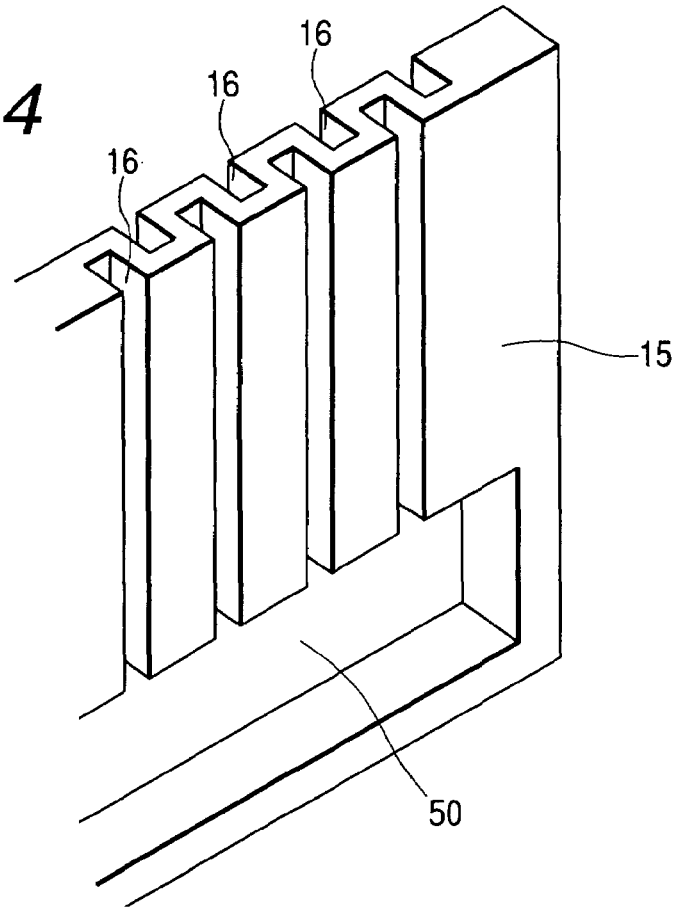
FIG. 4 is a perspective view of an ink flow channel substrate constituting the inkjet head of the invention.

Next, details of the inkjet head of the invention will be described. FIG. 2 is a cross-sectional view of an inkjet head used in the inkjet recorder of the invention, FIG. 3 is a cutaway plan view of the recording head when viewed from a nozzle orifice, and FIG. 4 is an enlarged perspective view of an ink flow channel substrate which will be described later. An example configuration of the inkjet head and an example sequence of assembly of the inkjet head will now be described.

A head substrate 20 includes a nozzle plate 10 on which are arranged a plurality of nozzle orifices 11 for ejecting ink droplets, an ink flow channel substrate 15 with small grooves 16, 16, . . . being formed therein, wherein each of the small groove 16 establishes mutual communication between the nozzle orifice 11 and a pressure generation chamber 14 and also establishes a mutual communication path from the pressure generation chamber 14 to a common ink puddle section 50, chamber plates 13*a*, 13*b* in which the pressure generation chambers 14 are formed so as to correspond to the small grooves 16 formed in the ink flow channel substrate 15, a diaphragm 18 for sealing the ink flow channel section formed from the pressure generation chambers 14 of the chamber plates 13*a*, 13*b* and the common ink puddle section 50, and pressure generator 30 provided so as to come into contact with the diaphragm 18. The head substrate 20 is retained by a high-rigidity member 25 which is higher in rigidity than the head substrate 20, thus constituting the inkjet head 1.

The ink flow channel substrate 15 is, e.g., a silicon substrate, and, as shown in FIG. 4, the small grooves 16, 16, . . . which serve as ink flow channels are formed in both surfaces of the plate and in equal number to the pressure generation chambers 14. The small grooves 16 are formed in both surfaces of the plate so as to assume a staggered arrangement. A pitch between the grooves formed in the respective surfaces is double a pitch Np between the plurality of nozzle orifices arranged on the nozzle plate 10. A pitch between the grooves 16 arranged in the staggered arrangement matches the nozzle pitch Np. The grooves 16 formed in both surfaces of the ink flow channel substrate 15 are formed to such a depth that an overlap exists between the grooves 16, and the grooves 16 remain in mutual communication with the common ink puddle section 50. Although the common ink puddle section 50 may be omitted, in such a case a deficiency arises in the supply of ink when a drive frequency is increased. Hence, the common ink puddle section 50 should be provided for ensuring the volumetric capacity of ink.

The chamber plates 13*a*, 13*b* having the pressure generation chambers 14 formed therein are stacked and bonded such that the ink flow channel substrate 15 is sandwiched between the chamber plates 13*a*, 13*b*. The pitch between the pressure generation chambers 14 formed in the chamber plates 13*a*, 13*b* is double the nozzle pitch Np. The pressure generation chambers 14 are formed in the chamber plates 13*a*, 13*b* in an offset manner so as to correspond to the small grooves 16 of the ink flow channel substrate 15. A common ink puddle section 50 analogous to that mentioned previously may be provided also in the chamber plates 13*a*, 13*b*. Moreover, the chamber plates 13*a*, 13*b* may be formed by etching a thin metal plate or a silicon substrate as in the case of the ink flow channel substrate 15. Partitions between the pressure generation chambers of the chamber plates 13*a*, 13*b* are preferably caused to essentially match the small groove 16 formed in the back surface to be bonded to the ink flow channel substrate 15. Since the bottom of the small grooves 16 is formed from a thin plate, the bottom directly experiences the pressure produced by the pressure generation chamber 14 for ejecting an ink droplet. However, the surface opposing the small grooves 16 is taken as a partition 12 of the pressure generation chamber 14. As a result, the pressure generated by pressure generator of the pressure generation chamber 14 can be supported, thereby preventing excessive deformation of the pressure generation chambers 14 and enabling an attempt to stabilize a characteristic.

Next, the diaphragm 18 is stacked and bonded so as to seal the pressure generation chamber 14 and the common ink puddle section 50. The thickness of the diaphragm 18 is generally selected so as to assume 15 μm or less if the diaphragm is a metal plate or so as to assume 30 μm or less if the diaphragm 18 is a thin plate of resin or the like. Moreover, the pressure generation chambers 14 whose bottom walls act as diaphragms with respect to the chamber plates 13*a*, 13*b* and the common ink puddle section 50 may also be formed as a single piece. As a result of the common ink puddle section 50 being sealed with a thin plate, i.e., the diaphragm 18, the diaphragm 18 of the common ink puddle section 50 is caused to absorb the pressure wave generated by the pressure generation chamber 14, thereby preventing propagation of the pressure to the adjacent pressure generation chambers 14 and diminishing interference between adjacent nozzles, that is, so-called crosstalk.

The thus-stacked head substrate 20 is held by the high-rigidity plate 25 whose rigidity is higher than that of the head substrate 20. The nozzle plate 10 in which the plurality of nozzle orifices 11 are arranged in essentially a row is bonded to the end section of the head substrate 20. Before the nozzle plate 10 is bonded to the head substrate 20, the surface of the multilayer member into which the plates are stacked, the surface to be bonded to the nozzle plate 10, is lapped, to thereby enhance flatness and stabilize characteristics.

Moreover, the outside of an area of the high-rigidity plate 25 to be bonded to the nozzle plate 10 is preferably projected. As a result, in relation to a problem of exfoliation of the nozzle plate 10 derived as a result of an object of printing, e.g., thick print paper, coming into contact with the nozzle plate 10 during the course of transport, a configuration doubling as a protective cover can be realized, thereby enabling an attempt to improve reliability against a failure in the head.

Figure 5:
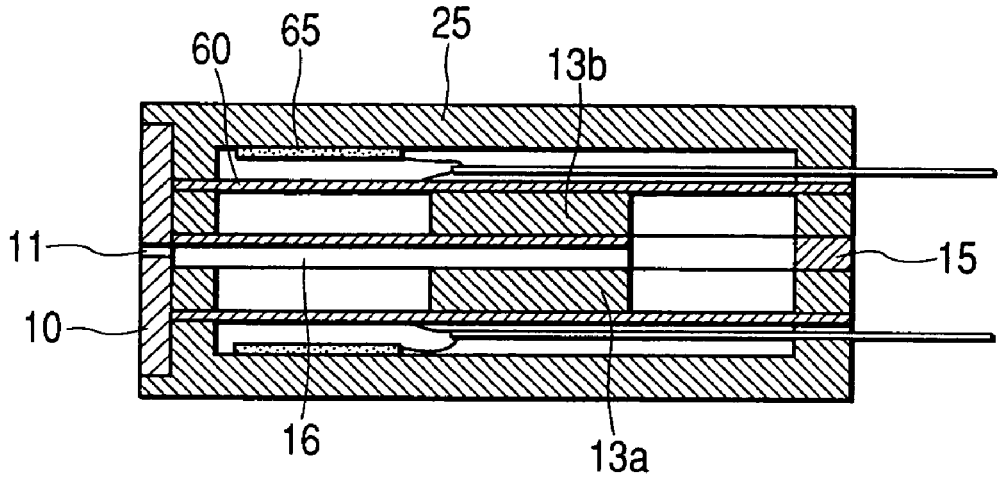
FIG. 5 is a cross-sectional view of another example of the inkjet head of the invention.

A piezoelectric thin film transducer 30 is provided as pressure generator on the diaphragm 18 constituting a portion of the pressure generation chamber 14 of the embodiment. However, as shown in FIG. 5, there may also be employed a transducer of electrostatic actuation type, wherein the transducer is provided with a diaphragm 60 doubling as an electrode substrate and an individual electrode 65 disposed at a position opposite the diaphragm 60, and wherein electrostatic force developing between the electrodes is employed. In the transducer of either type, that is, a piezoelectric thin film type or a electrostatic actuation type, the pressure generator can be formed from a thin film and does not require much packaging space. Therefore, the inkjet head using this type can be made compact, and hence an inkjet recording apparatus can eventually be made compact.

Figure 6:
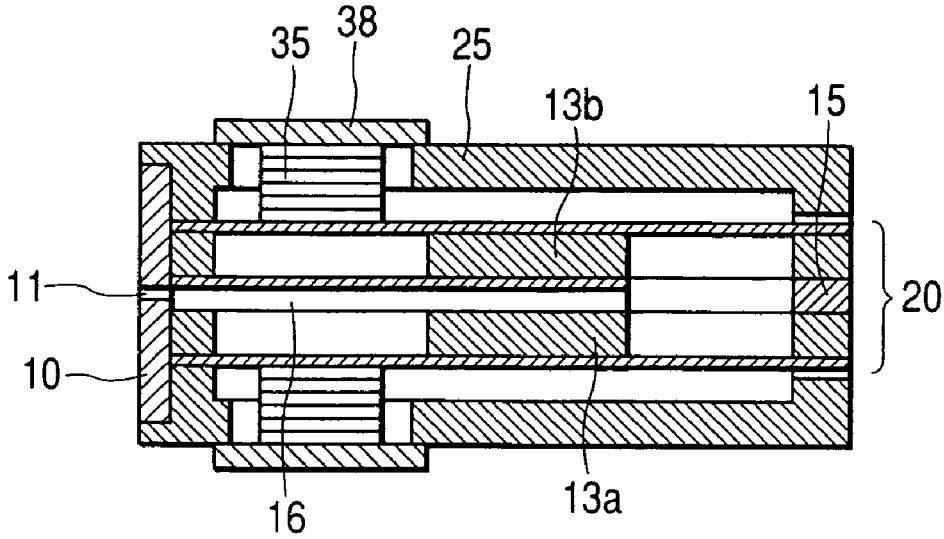
FIG. 6 is a cross-sectional view of another example of the inkjet head of the invention.

If a somewhat packaging space can be ensured, there may also be employed a stacked piezoelectric element 35 formed by alternately stacking a piezoelectric material and a conductive material in the manner as shown in FIG. 6. When compared with the piezoelectric thin-film transducer 30, the stacked piezoelectric element 35 can produce great displacement and therefore is suitable for use with an inkjet head for ejecting large ink droplets. The stacked piezoelectric element 35 can be readily constituted by means of: fixing one end thereof with a fixing member 38, inserting the stacked piezoelectric element 35 into an aperture of the opening section formed in the high-rigidity plate 25, and bringing the free end side of the piezoelectric element into contact with the diaphragm 18. The fixing member 38 preferably has a Young's modulus which is equal to or higher than that of the piezoelectric element and may be given rigidity greater than that of the head substrate 20 into which the plates are stacked. As a result, the fixing member 38 can sufficiently withstand the force derived from displacement of the stacked piezoelectric element 35.

Figure 7:
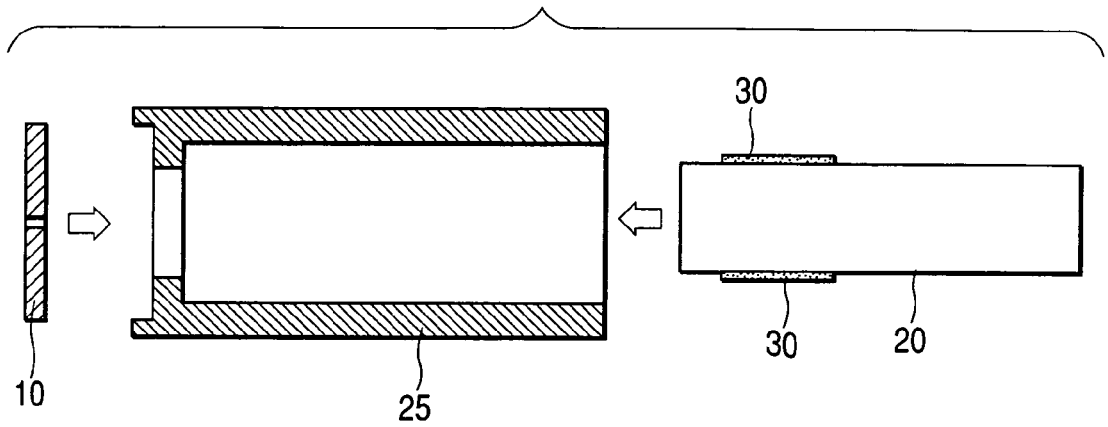
FIG. 7 is an exploded cross-sectional view showing another example of the inkjet head of the invention.

The high-rigid plate 25 may be constituted of mutually-independent members. However, as shown in FIG. 7, there may be formed a hole into which the head substrate 20 formed by bonding and stacking the plates is to be inserted, and the high-rigid plate 25 may be fixed to at least one side of the hole.

Figure 8:
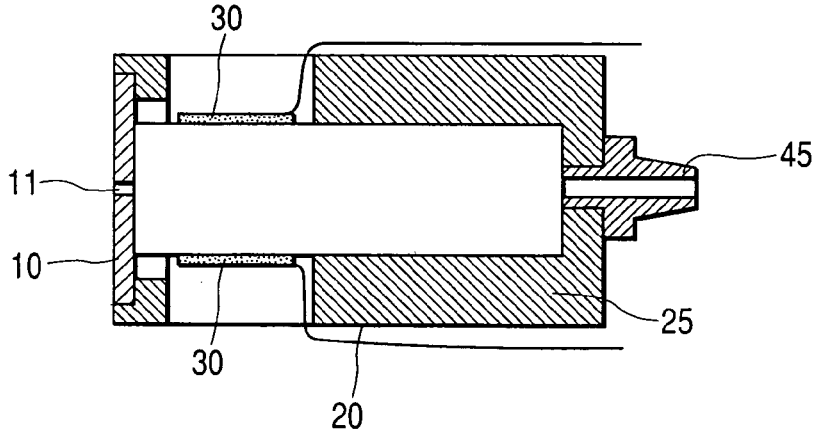
FIG. 8 is a cross-sectional view of another example of the inkjet head of the invention.

As shown in FIG. 8, the back of the high-rigidity plate 25 may be sealed, and the hole may be formed into a blind-hole-like groove. The stacked head substrate 20 may be fixed so as to come into contact with the hole. By means of such a configuration, an ink supply port 45 for supplying ink into the inkjet head can be provided on the position opposite to the nozzle plate 10. When the plurality of heads 1 are used while being arranged side by side, there can be achieved packaging density higher than that achieved when a side wall is also provided.

Figure 9:
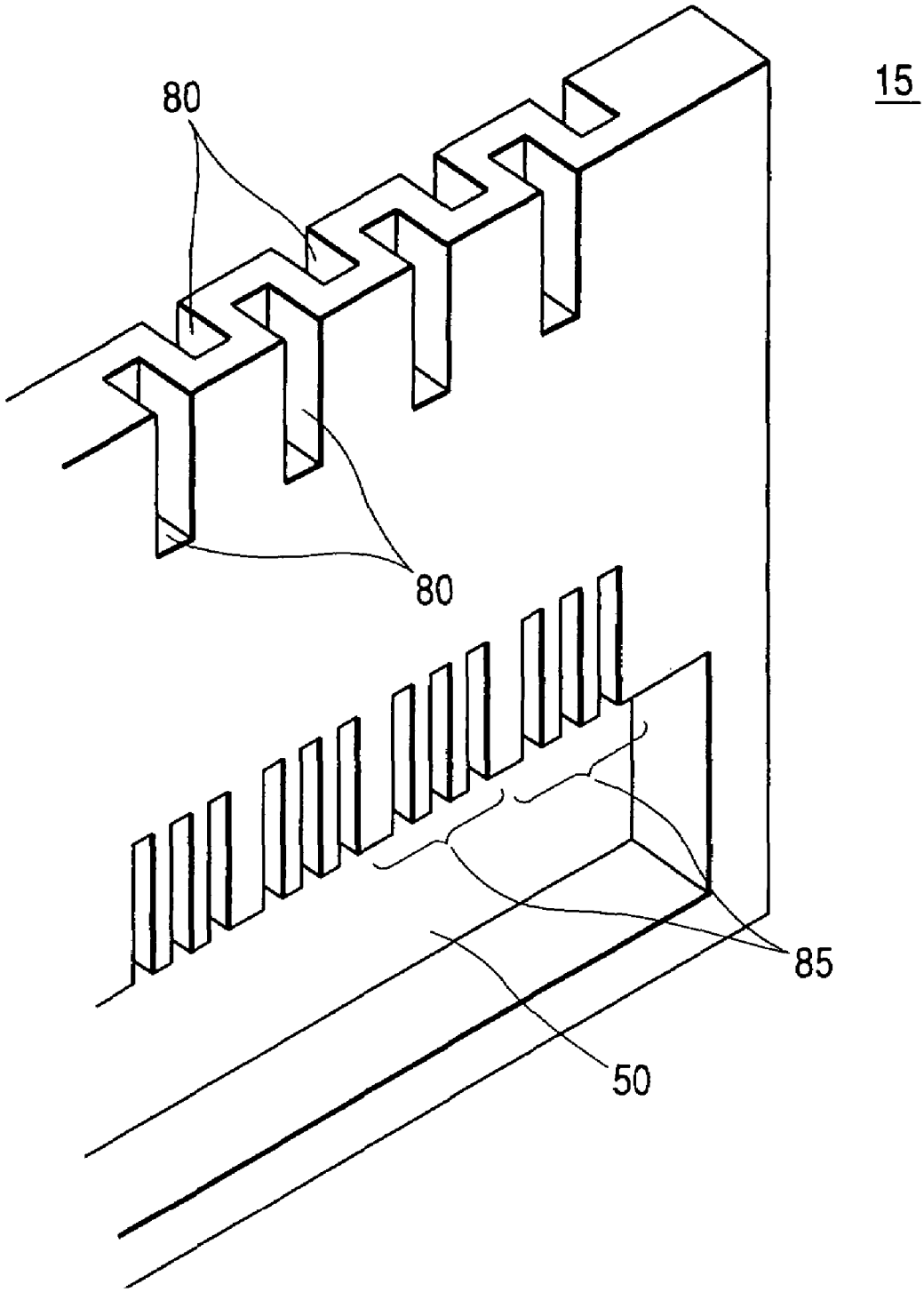
FIG. 9 is a perspective view of another example of the ink flow channel substrate constituting the inkjet head of the invention.
Figure 10:
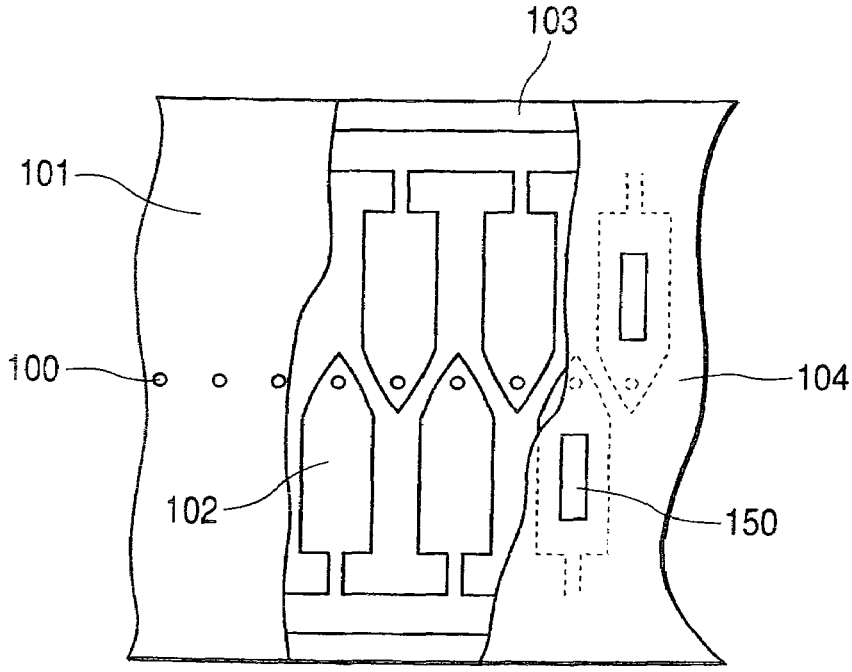
(RELATED ART) FIG. 10
FIG. 10 is a cutaway plan view showing the configuration of an ink flow channel substrate constituting a related-art inkjet head.

FIG. 9 shows another example configuration of the ink flow channel substrate 15, that is, another example configuration of the grooves formed in the ink flow channel substrate 15. The groove is formed from two separate grooves, that is, a groove 80 communicating from the nozzle orifice 11 toward the pressure generation chamber, and another groove (hereinafter called a "restrictor groove 85") communicating from the pressure generation chamber 14 to the common ink puddle section 50. Moreover, the restrictor groove 85 may be formed from one groove or more. Moreover, the number of restrictor grooves 85 and the optimal thickness and length thereof are determined on the basis of a balance between inertance and resistance at the nozzle orifice section and the restrictor groove section. Therefore, as a matter of course, the groove communicating with the nozzle 11 and the groove communicating with the common ink puddle section 50 may differ from each other in terms of a depth, a cross-sectional area, and a length.

The cross-sectional profile of the groove section may assume any shape, such as a rectangle, a triangle, a semicircle, or the like, so long as the relationship between the inertance and the resistance can be maintained. The method for forming a groove enables realization of accurate machining regardless of whether the processing is etching of a silicon substrate or dicing of a ceramic substrate through use of a disc grinding stone.

A difference between the configuration of the related-art inkjet head described in connection with JP-A-6-8449 and the configuration of the present embodiment will now be described. In the case of the related-art example, nozzle orifices, pressure chambers, and restrictors are formed in a member corresponding to the flow channel substrate 15. Therefore, the nozzle orifices are arranged not in one row but inevitably in a staggered arrangement. However, in the case of the inkjet head of the invention, the grooves formed in the flow channel substrate 15 constitute a portion of the ink flow channel. A nozzle plate is disposed on the front surface of the ink flow channel. Hence, the flow channel substrate 15 can have nozzle orifices whose nozzles are arranged in a straight line. Consequently, a necessity for correcting a timing at which an ink droplet is to be ejected from an adjacent nozzle is obviated, thereby realizing an attempt to simplify control operation.

For instance, there is a case where there is performed shift drive operation for avoiding synchronous actuation of adjacent nozzles by shifting print timing with a view toward lessening crosstalk or the like. Even in such a case, the control operation can be readily customized by shifting only the positions of the nozzle orifices of the nozzle plate 10 disposed at the front surface in the primary scanning direction (i.e., in the case of an inkjet head of carriage type, a direction in which the inkjet head is to be moved to perform printing operation, or in a case where the recording head performs printing operation while remaining stationary, a direction in which paper is to be transported).

Figure 11:
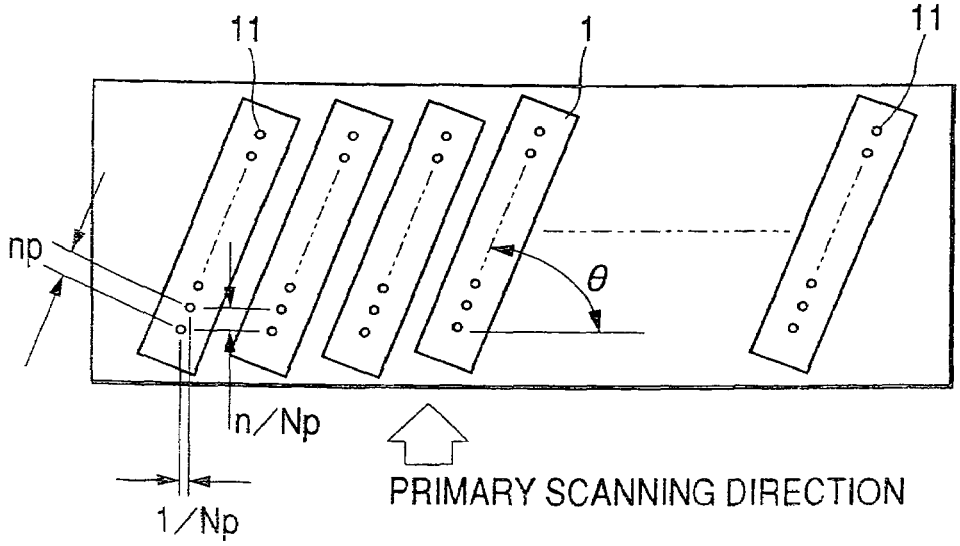
FIG. 11 is a descriptive view showing a relationship between print density and a nozzle pitch obtained when the inkjet head is arranged obliquely.

Alternatively, an inkjet head is disposed diagonally as means for increasing print density, whereby there can be increased a pitch between adjacent nozzles in the secondary scanning direction (i.e., in the case of an inkjet head of carriage type, a direction perpendicular to the direction in which the recording head is moved to perform printing operation, or in a case where the recording head performs printing operation while remaining stationary, a direction perpendicular to the direction in which paper is to be transported). FIG. 11 shows a relationship between print density achieved when the inkjet head is arranged obliquely and the nozzle pitch. In the drawing, under the assumption that a print density to be obtained is taken as Np, an apparent nozzle pitch in the scanning direction is taken as n/Np ("n" is a natural number of 2 or more), and a pitch between nozzle orifices arranged in a recording head is taken as "np", the nozzle pitch "np" of the inkjet head can be expressed by the following relationship.

$$np=\sqrt{(n^2+1)}/Np$$

Even in this case, as in the case of the previous embodiment, nozzle pitch can be readily customized by means of changing only the positions of the nozzles of only the nozzle plate 10, in the primary scanning direction.

No pressure generation chambers are formed in the ink flow channel 15, and the ink flow channel substrate 15 is formed from another substrate. For instance, when a desire exists for changing the quantity of ink to be ejected, the volumetric capacity of the pressure generation chambers formed in the substrates 13*a*, 13*b* having the pressure chambers formed therein can also be changed, thereby facilitating realization of parts common to serialized inkjet heads which differ from each other in terms of the quantity of ink ejected. However, application of the related-art example involves a necessity for making a new silicon monocrystal substrate. The related-art inkjet head cannot find any application and copes with only a limited usage. Hence, the inkjet head of the invention differs from the related-art inkjet head in terms of basic viewpoint.

As mentioned above, an inkjet head of the invention is for use with an inkjet recording apparatus having a plurality of nozzle orifices, pressure generation chambers corresponding to the nozzle orifices, and pressure generator for producing fluctuations in the pressure generation chambers, wherein an ink droplet is ejected from the nozzle orifice by changing the volumetric capacity of the pressure generation chamber, to thereby print characters, figures, or the like. The inkjet recording apparatus includes a nozzle plate having a plurality of nozzle orifices arranged thereon, a chamber plate having pressure generation chambers, a diaphragm having resilience for sealing the pressure generation chambers, and an ink flow channel substrate having a groove which is in communication with the nozzle orifice by way of the pressure generation chamber from a common ink puddle section and is smaller in width than that of the pressure generation chamber. Grooves are formed in both surfaces of the ink flow channel substrate, in a staggered pattern. The chamber plates are stacked so as to correspond to the grooves and such that the ink flow channel substrate is sandwiched between the chamber plates. The chamber plates are stacked and sealed with diaphragms, and the nozzle plate is fixed to ends of the grooves formed in the ink flow channel substrate. Hence, even when packaging pitch of nozzles is increased, a pitch between the pressure generation chambers can be made double, there by facilitating designing and packaging of the head.

Partitions between the adjacent pressure generation chambers of the chamber plate are arranged so as to correspond to positions on the back of the grooves formed in the ink flow channel substrate. Hence, the rigidity of the pressure generation chambers can be enhanced, to thereby realize an attempt to improve an ejection characteristic.

Another invention is directed to an inkjet recording apparatus having a plurality of nozzle orifices, pressure generation chambers corresponding to the nozzle orifices, and pressure generator for producing fluctuations in the pressure generation chambers, wherein an ink droplet is ejected from the nozzle orifice by changing the volumetric capacity of the pressure generation chamber, to thereby print characters, figures, or the like. The inkjet recording apparatus includes a nozzle plate having a plurality of nozzle orifices arranged thereon, a chamber plate having pressure generation chambers, a diaphragm having resilience for sealing the pressure generation chambers, one groove remaining in communication with the pressure generation chamber from the nozzle orifice, and an ink flow channel substrate having at least one communication groove which supplies ink from a common ink puddle section to the pressure generation chamber. The grooves formed in the ink flow channel substrate are arranged so as to assume a staggered pattern on both surfaces. The chamber plates are stacked so as to correspond to the grooves and such that the ink flow channel substrate is sandwiched between the chamber plates. The chamber plates are stacked and sealed with diaphragms, and the nozzle plate is fixed to ends of the grooves formed in the ink flow channel substrate. Hence, the flow channel resistance of the restrictor can be readily designed with good balance, and a high-response recording head can be provided.

The surface of the nozzle substrate where the nozzle orifices are formed is located at a position lower than the surface of a flat section of the highly-rigid member opposing the nozzle orifices. Therefore, there can be prevented infliction of flaws in the nozzle plate, which would otherwise be caused when a medium comes into contact with the nozzle plate during printing operation, and hence a highly-reliable head can be provided.

What is claimed is:

1. An inkjet head, comprising:

a common ink puddle section;

a nozzle plate comprising a plurality of nozzle orifices arranged thereon;

an ink flow channel substrate comprising grooves, the grooves communicating from the common ink puddle section to the nozzle orifices, the grooves being formed alternately in a front surface and a back surface of the ink flow channel substrate, the nozzle plate being fixed to end sections of the grooves;

a chamber plate being stacked on the ink flow channel substrate, the chamber plate comprising pressure generation chambers corresponding to the nozzle orifices, the pressure generation chambers being larger in width than the grooves;

a diaphragm stacking on one surface of the chamber plate opposite from the ink flow channel substrate; and a pressure generator provided on the diaphragm for the pressure generation chambers to generate a change in an internal pressure of the pressure generation chambers, wherein the common ink puddle section remains in communication with the pressure generation chambers to supply ink to the pressure generation chambers, wherein a volumetric capacity of the pressure generation chambers is changed in accordance with a change in the pressure of the pressure generation chambers, to eject an ink droplet from the nozzle orifice, and wherein an entire width of the pressure generation chambers is larger than an entire width of the grooves, wherein each nozzle orifice on the nozzle plate is arranged on a single straight line.

2. The inkjet head according to claim 1, wherein partitions between the adjacent pressure generation chambers of the chamber plate are arranged so as to correspond to positions on a back of the grooves formed in the ink flow channel substrate.

3. The inkjet head according to claim 1, wherein the groove formed in the ink flow channel substrate comprises a first portion, by way of the first portion ink flows into the pressure generation chambers, and a second portion close to the nozzle orifice, end wherein the first portion is smaller in cross-sectional area than the second portion.

4. The inkjet head according to claim 1, wherein the grooves are divided into a plurality of grooves in the vicinity of the common ink puddle section.

5. The inkjet head according to claim 1, wherein the inkjet head is retained by a highly-rigid member.

6. The inkjet head according to claim 5, wherein the highly-rigid member includes one of a channel and a groove to be used for supplying ink to the common ink puddle section.

7. The inkjet head according to claim 6, wherein a surface of the nozzle plate is located at a position lower than a surface of a flat section of the highly-rigid member opposing the nozzle orifice.

8. The inkjet head according to claim 5, wherein a hole section is formed an the highly-rigid member in a direction in which a piezoelectric element is brought into contact with the diaphragm, and wherein the piezoelectric element, which is retained by the fixing member, is inserted into the hole section.

9. The inkjet head according to claim 1, wherein the pressure generator utilizes displacement force of a stacked piezoelectric element, and wherein a piezoelectric material and a conductive material are stacked alternately in the piezoelectric element.

10. The inkjet head according to claim 9, wherein the stacked piezoelectric element is retained by a fixing member, and wherein the fixing member has a Young's modulus equal to or greater than that of the piezoelectric material.

11. The inkjet head according to claim 10, wherein the fixing member has a rigidity that is greater than that of the ink flow channel substrate.

12. The inkjet head according to claim 1, wherein the pressure generator utilizes electrostatic force.

13. The inkjet head according to claim 1, wherein the pressure generator utilizes displacement force of a piezoelectric thin-film element.

14. The inkjet head according to claim 1, wherein a number of grooves is equal to a number of pressure generation chambers.

15. The inkjet head according to claim 1, wherein the pressure generation chambers are formed in the chamber plate in an offset arrangement to correspond to the grooves.

16. The inkjet head according to claim 1, wherein the pressure generator comprises a thin-film.

17. An inkjet recorder, comprising:

an inkjet head according to claim 1.

18. The inkjet head according to claim 1, wherein said nozzle plate is separate from said ink flow channel substrate and fixed to an end of said ink flow channel substrate.

19. The inkjet head according to claim 1, further comprising:

a second chamber plate being stacked on said ink flow channel substrate, said second chamber plate comprising pressure generation chambers corresponding to the nozzle orifices, wherein said chamber plate is stacked on a first surface of said ink flow channel substrate and said second chamber plate is stacked on a second surface of said ink flow channel substrate.

20. The inkjet head according to claim 19, further comprising a second pressure generator provided on said second diaphragm for the pressure generation chambers on said second chamber plate to generate a change in an internal pressure of the pressure generation chambers on said second chamber plate, wherein said second diaphragm is stacked on a surface of said second chamber plate opposite from said ink flow channel substrate.

21. The inkjet head according to claim 1, further comprising:

a second pressure generator provided on said second diaphragm for the pressure generation chambers to generate a change in an internal pressure of the pressure generation chambers.

* * * * *